US005898936A

United States Patent [19]

Janes

[11] Patent Number: 5,898,936

[45] Date of Patent: May 4, 1999

[54] PROTECTIVE WRIST GUARD ASSEMBLY

[76] Inventor: Peter C. Janes, 2734 Estates Dr., Breckenridge, Colo. 80424

[21] Appl. No.: 08/690,733

[22] Filed: Jul. 31, 1996

[51] Int. Cl.[6] ..... A41D 19/00

[52] U.S. Cl. ..... 2/16; 2/160; 2/161.1; 2/162

[58] Field of Search ..... 2/16, 17, 160, 2/161.1, 161.5, 161.6, 162, 164, 165, 166, 170, 159, 158, 161.2, 161.3, 161.4, 161.7, 161.8, 163, 167, 168, 169

[56] References Cited

U.S. PATENT DOCUMENTS

| | | | |
|---|---|---|---|
| 1,469,315 | 10/1923 | Hansard | 2/162 |
| 3,924,272 | 12/1975 | Allen et al. | 2/16 |
| 4,011,596 | 3/1977 | Chang | 2/16 |
| 4,190,902 | 3/1980 | Rhee | 2/16 |
| 4,536,890 | 8/1985 | Barnett et al. | 2/164 |
| 5,361,415 | 11/1994 | Deering et al. | 2/160 |
| 5,537,692 | 7/1996 | Dorr | 2/16 |
| 5,561,856 | 10/1996 | Pesco | 2/16 |

OTHER PUBLICATIONS

Gershman, Maurice, "Slef–Adhering Nylon Tapes." The J.A.M.A., vol. 168, No. 7, p. 930, Oct. 1958.

*Primary Examiner*—Jeanette Chapman
*Attorney, Agent, or Firm*—Phillip A Rein

[57] ABSTRACT

A protective wrist guard assembly having a pair of wrist guard glove assemblies connected to respective right and left forearm/wrist/hand of a skateboard or snowboard rider. Each wrist guard glove assembly is provided with a protective main glove assembly having a wrist support guard assembly mounted therein. The protective main glove assembly resembles a conventional snowboard or ski glove assembly having 1) a main glove body member; 2) an exterior anchor assembly secured to the main glove body member; 3) an interior wrist guard anchor assembly for securing the wrist support guard assembly within the main glove body member; and 4) a glove insert member mounted within the main glove body member and adapted to receive a wrist and hand section of the snowboard rider therein. The exterior anchor assembly is provided with spaced anchor strap members secured as by Velcro members thereabout for anchoring the combination main glove body member to the wrist support guard assembly and the forearm, wrist, and hand sections of the snowboard rider. The wrist support guard assembly is provided with a primary support body assembly having inner and outer support layer members and pre-engineered to provide support to the forearm, wrist, and hand sections of the snowboard rider to prevent injury thereto. A second embodiment includes the primary support body assembly secured by a wrist anchor assembly about the forearm, wrist, and hand sections of the snowboard rider. A third embodiment includes a partial glove wrist guard assembly having a protective partial glove assembly with a support guard member therein. The support guard member is of rigid plate construction with an inclined portion to receive and support a palm section of the snowboard rider to prevent injury to the wrist section.

16 Claims, 5 Drawing Sheets

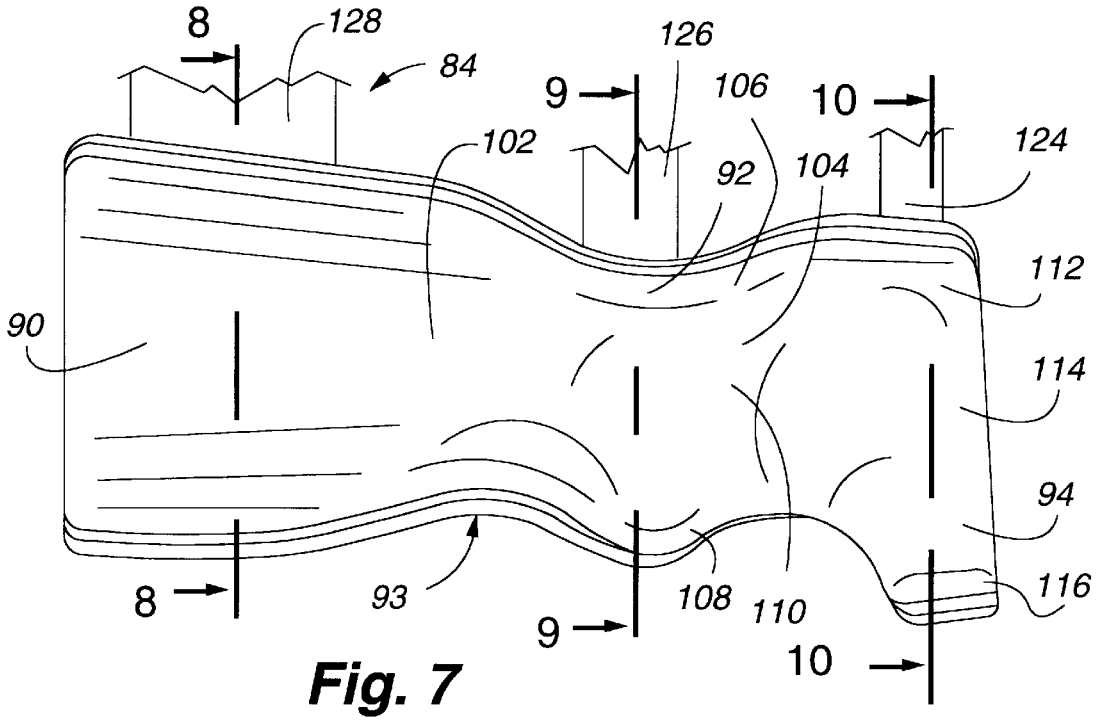
Fig. 7
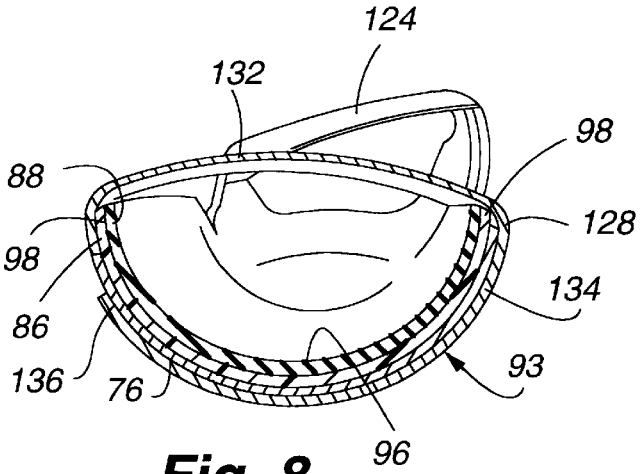
Fig. 8
Fig. 9
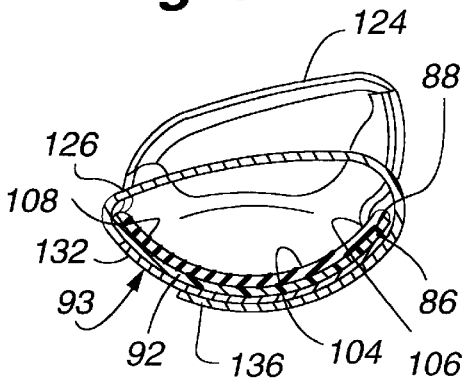
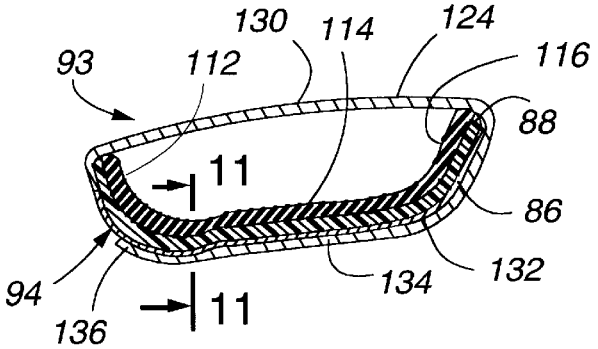
Fig. 10

PROTECTIVE WRIST GUARD ASSEMBLY

PRIOR ART

A patent search revealed the following United States patents:

| U.S. Pat. No. | Inventor |
|---|---|
| 2,751,595 | Patraw, D.T. et al |
| 4,011,596 | Chang, E.G. |
| 4,190,902 | Rhee, J.G. |
| 4,852,557 | Grim, T.E. |
| 4,881,533 | Teurlings, L. |
| 4,905,320 | Squyers, T.L., Jr. |
| 4,925,187 | Fleenor, C.R. et al |
| 4,928,678 | Grim, T.E. |
| 4,942,624 | Cho, S.S. |
| 4,984,300 | Cho, S.S. |

Chang discloses a forearm and wrist protector used to protect fractures and injuries to skateboarders which extends from the palmar side of the hand across the wrist and forearm and is secured by straps. The forearm portion is in the form of a sleeve and a hinge or joint member forms a connection between rigid splint areas.

The Rhee patent discloses a protective device for the elbow, arm, palm, and hand intended for use by skateboarders which is constructed of a resilient foam material designed to extend from the palmar side of the hand to a point beyond and above the elbow. A section of reduced width across a wrist permits freedom of movement and does not rigidly protect against movement.

The Fleenor et al patent discloses a bowling hand and wrist support device as a bowling training device but doesn't restrict movement of an individual's wrist to prevent injury thereto.

The Cho '624 patent discloses a protective arm gear similar to that of Rhee designed for extension along the back of the hand, wrist, forearm, and elbow. This is manufactured from a resilient foam material.

The Cho '300 patent discloses a protective glove having connector straps but constructed of a foam material.

The Grim patents disclose soft-goods type, formable orthopedic casts using anchor straps about the hand, wrist, and forearm portion of an individual but providing support in a different manner.

The other references are not deemed pertinent to the applicant's invention.

PREFERRED EMBODIMENT OF THE INVENTION

In one preferred embodiment of this invention, a protective wrist guard assembly is provided which is operable to be mounted on a portion of an arm member of a snowboard rider while riding a snowboard member over a snow covered terrain. The snowboard rider is wearing snowboard boot members which are releasably connected to an upper surface of a snowboard member while traversing a portion of the snow covered terrain.

The snowboard rider has each arm member formed with a forearm section integral with a wrist section which, in turn, is integral with a hand section. It has been found that the snowboard rider usually falls forwardly when losing balance and, without ski poles, an extended handle section hits the ground support surface with a bent portion of the wrist section and, subsequently, causes injury by a fracture, breakage, or other severe damage thereto.

The protective wrist guard assembly of this invention is operable to be worn by the snowboard rider about the forearm, wrist, and hand section to provide a rigid support assembly to prevent injury primarily to a flexing portion of the wrist section of the arm member of the snowboard rider.

The protective wrist guard assembly consists of three embodiments with the first embodiment having a wrist guard glove assembly, being two thereof, with one applied respectively to a left arm member and the other to a right arm member of the of the snowboard rider.

Each of the wrist guard glove assemblies includes 1) a protective main glove assembly resembling a conventional snowboard or ski insulated glove assembly; and 2) a wrist support guard assembly mounted within the protective main glove assembly.

The protective main glove assembly includes 1) a main glove body member; 2) an exterior anchor assembly mounted about the main glove body member to selectively hold in a supported, usage position on the forearm, wrist, and palm portions of the snowboard rider; 3) an interior insert anchor assembly mounted within the main glove body member to secure and anchor the wrist support guard assembly therein; and 4) a glove insert member mounted on the wrist support guard assembly.

As shown in FIG. 2, the main glove body member includes a forearm cover section integral with a wrist cover section which, in turn, is integral with a hand cover section. The forearm cover section is provided with an anchor strap member mounted within a strap support section. The anchor strap member is selectively operable to be expanded and contracted to provide a firm sealing contact with the forearm section (next to an elbow) of the arm member of the snowboard rider to provide a sealing from the elements, namely, cold and snow.

The hand cover section is provided with finger enclosure portions and a thumb enclosure portion resembling the normal respective finger and thumb areas on a conventional snowboard or ski glove assembly.

The exterior anchor assembly includes a wrist anchor member and an upper palmar anchor member. The wrist anchor member includes a wrist anchor strap mounted about the wrist cover section and secured in an enclosed locked position by an anchor buckle member and a Velcro member.

The upper palmar anchor member includes a palm anchor strap mounted about a junction of the finger enclosure portions and the thumb enclosure portion and secured thereto by an anchor buckle member and a Velcro member.

The interior wrist guard anchor assembly includes 1) a palmar anchor member; 2) a wrist anchor member; and 3) a forearm anchor member, all constructed of a Velcro connector assembly having hook and loop sections operable in a conventional manner for securing to the wrist support guard assembly.

The glove insert member includes a wrist support integral with a palm/finger support mounted within the wrist and hand cover sections of the main glove body member of the protective main glove assembly.

The wrist support guard assembly includes 1) a primary support body assembly; and 2) the interior wrist guard anchor previously described connected to outer surfaces of spaced portions of the primary support body assembly.

The primary support body assembly includes an outer support layer member having an inner support layer member superimposed thereon being of the same size and configuration as the outer support layer member. The outer support layer member is constructed of a semi-rigid plastic material which is slightly flexible, imperious to moisture, and can withstand extreme changes in temperature.

The inner support layer member is preferably constructed of a water impervious cushion rubber type material to provide warmth and cushioning to the forearm, wrist, and hand sections of a snowboard rider to be supported and anchored thereto as will be noted.

The outer and inner support layer members are secured to each other being superimposed and each provided with 1) a forearm support section; 2) an intermediate wrist support section integral with the forearm support section; and 3) a palm support section integral with an outer end of the intermediate wrist support section.

The forearm support section is provided with an arcuate mid portion having integral outer sides thereof with arcuate side wall portions and having a central downwardly tapered connector portion to be connected to the intermediate wrist support section. The forearm support section is of a semi-circular shape in axial transverse cross section.

As noted in FIG. 9, the intermediate wrist support section includes 1) a palm receiver portion; 2) a lateral wrist support portion integral with the palm receiver portion; 3) a thumb/wrist support portion integral with an opposite side of the palm receiver portion; and 4) a hand transition portion integral with the palm support section. The hand transition portion is a continuation of the tapered connector portion and of a semi-circular shape in axial transverse cross section operable to receive and support the outer carpal bones in a user's hand.

The palm support section is provided with a small finger retainer portion integral with a central palm support portion which, in turn, is integral with a forefinger retainer portion. The central palm support portion is contoured and having outwardly upturned portions, being the small finger retainer portion and the forefinger retainer portion, as noted in FIG. 10.

Between the thumb wrist support portion and the forefinger retainer portion is formed an arcuate thumb cut-out portion to receive a base portion of a user's thumb therethrough.

A second embodiment of this invention is shown in FIGS. 5–10 which includes 1) a basic wrist support guard assembly having the previously described a) outer support layer member secured to the inner support layer member; and 2) a wrist anchor assembly to releasably connect the primary support body assembly about a respective arm member of a user thereof.

The wrist anchor assembly includes 1) an upper palm anchor member; 2) a wrist support anchor member; and 3) a forearm support anchor member. The upper palm anchor member includes a main support strap member having a central section integral at one end with a first strap section and integral at an opposite end with a second strap section. Each strap section is provided with Velcro members having a respective hook section and a loop section for joining to each other.

For example, the first strap section can have an internal hook section and the second strap section can have an outer loop section which are joined together in a conventional manner. This provides an adjustable feature for mounting the main support strap member in a snug, secure manner about the outer palm portion of the arm member of the snowboard rider therein.

The wrist support anchor member and the forearm support anchor member are similar as described for the upper palm anchor member but having a main support strap member of various widths as described for anchoring in the mounted, anchored condition by the Velcro members.

A third embodiment of this invention, as noted in FIGS. 11 and 12, is a partial glove wrist guard assembly having 1) a protective partial glove assembly; and 2) a rigid wrist support guard member releasably mounted within the protective partial glove assembly.

The protective partial glove assembly includes a partial glove body member and having mounted thereabout a partial glove anchor assembly. The partial glove body member includes a forearm support portion which is integral with a wrist support portion which, in turn, is integral with a palm support portion.

The palm support portion is provided with an outer finger extension opening to receive the finger members of a snowboard rider therein and a thumb extension opening to receive the thumb portion of a snowboard rider therethrough as will be noted.

The partial glove anchor assembly includes a forearm support member and a dual wrist support member. The forearm support member includes a strap member connected by Velcro a member to an adjacent outer surface of the forearm support portion in a conventional manner.

The dual wrist support member includes a strap member identical to the forearm support member and anchored by the Velcro member about the wrist section of the snowboard rider.

The dual wrist support member includes an elongated strap having one end secured to the wrist support portion of the partial glove body member. The elongated strap is operable to be wrapped about the wrist support portion and secured to itself in a clamped condition by a Velcro member in a conventional manner.

The forearm support section is provided with a guard receiver slot therein being an entrance to a pocket member extended from the forearm support portion through the wrist support portion to the palm support portion to receive and support the wrist support guard member therein.

The wrist support guard member is constructed of a rigid metallic material, such as aluminum or stainless steel, and provided with a primary support section integral at one end with a palm support section.

The palm support section has an inclined portion leading to a support portion being operable to receive the forearm, wrist, and hand sections of the snowboard rider thereagainst when in the usage condition as will be noted.

OBJECTS OF THE INVENTION

One object of this invention is to provide a protective wrist guard assembly in different embodiments being 1) a wrist guard glove assembly mountable on outer respective hands of the snowboard rider and resembling a normal cold weather snowboard and ski glove assembly having a wrist support guard assembly mounted herein; 2) a wrist support guard assembly which can be mounted about the forearm, wrist, and hand section of the arm member of a snowboard rider but not providing any protection from the cold weather and, thus, is operable then to be mounted within a snowboard or ski glove assembly provided by the snowboard rider thereof, 3) a partial glove wrist guard assembly mounted about a respective hand of the snowboard rider and having therein a partial glove body member secured by a partial glove anchor assembly and having mounted therein a wrist support guard member being of a generally J-shape to provide necessary rigid support protection to the forearm, wrist, and hand sections of the snowboard rider.

Another object of this invention is to provide a protective wrist guard assembly having a wrist guard glove assembly including 1) a protective main glove assembly resembling a conventional snowboard or ski glove assembly; and 2) a wrist support guard assembly mounted within the protective main glove assembly to receive the forearm, wrist, and hand sections of a snowboard rider therein and having an exterior anchor assembly for securing to a respective arm member of a snowboard rider appearing as a conventional cold weather glove assembly.

One other object of this invention is to provide a protective wrist guard assembly having a wrist support guard assembly with a primary support body assembly of contoured shape having outer and inner support layer members whereupon the entire wrist support guard assembly is mounted on a respective arm member of a snowboard rider and operable to be placed within and enclosed by a conventional snowboard or ski glove assembly.

A further object of this invention is to provide a protective wrist guard assembly including a partial glove wrist guard assembly having a partial glove body member adapted to be secured as by a partial glove anchor assembly about forearm, wrist, and hand sections of the respective arm member of the snowboard rider being utilized therein and having a wrist support guard member of a generally J-shape in rigid construction to provide a low cost, economical embodiment of this invention.

One further object of this invention is to provide a protective wrist guard assembly having a wrist support guard assembly having a primary support body assembly with a rigid inner support layer member and an outer support layer member of a resilient cushion material, both layer members being impervious to moisture and conforming to a rigid pre-determined shape to provide the utmost support to the forearm, wrist, and hand section of the arm member of the snowboard rider to prevent injury such as breakage and fracturing of the wrist section area of the snowboard rider.

Still, one further object of this invention is to provide a protective wrist guard assembly with a wrist support guard assembly having a primary support body assembly secured by a wrist anchor assembly to the forearm, wrist, and hand section of the arm member of the snowboard rider and being of a specific contour to provide the necessary support against the wrist and palm area to prevent fracture and/or breakage thereof caused by using the wrist and hand areas to break a fall by a snowboard rider onto the adjacent snow terrain.

Another object of this invention is to provide a protective wrist guard assembly having a wrist support guard assembly with a primary support body assembly of a predetermined, engineered contour to protect the forearm, wrist, and hand sections of the snowboard rider against injury during a snowboarding accident operable to readily receive a conventional snowboard or ski cold weather glove assembly mounted thereabout and, therefore, being an economical embodiment of the invention which is inexpensive to manufacture; easy to assemble and disassemble from the user's arm member; securely fastened as by Velcro connectors; and substantially maintenance free.

One other object of this invention is to provide a protective wrist guard assembly including a wrist guard glove assembly for each hand of the snowboard rider which resembles a conventional snowboard or ski glove assembly.

Still, one other object of this invention is to provide a protective wrist guard assembly including a partial glove wrist guard assembly having a partial glove body member releasably secured by a partial glove anchor assembly to a respective arm member of a snowboard rider and having an economical wrist support guard member insertable within a guard receiver slot in the partial glove body member and the wrist support guard member is manufactured with aluminum or stainless steel of substantially J-shape and releasably insertable within the partial glove body member to provide the necessary support to the forearm, wrist, and hand sections of the arm member of the snowboard rider.

Still, one further object of this invention is to provide a wrist support guard assembly having a primary support body assembly of a unique engineered contour and shape to receive and support an undersurface of the forearm, wrist, and hand sections of a respective arm member of a snowboard rider.

Various other objects, advantages, and features of the invention will become apparent to those skilled in the art from the following discussion, taken in conjunction with the accompanying drawings, in which:

FIGURES OF THE INVENTION

FIG. 7 is a fragmentary top plan view of a second embodiment with anchor members in an open condition for clarity;

FIG. 8 is a sectional view taken along line 8—8 in FIG. 7;

FIG. 9 is a sectional view taken along line 9—9 in FIG. 7;

FIG. 10 is a sectional view taken along line 10—10 in FIG. 7;

Figure 1:
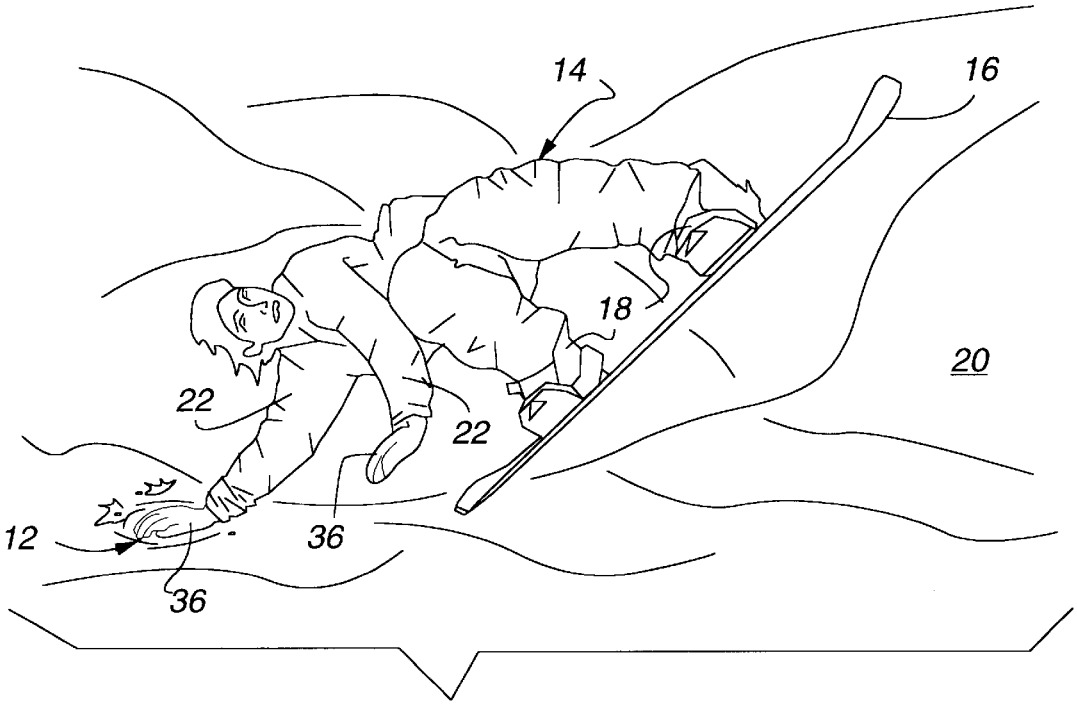
FIG. 1 is a perspective view of a snowboard rider in an act of falling on its' right wrist which has been protected by being enclosed by a snowboard protective wrist guard assembly of this invention.

The following is a discussion and description of preferred specific embodiments of the protective wrist guard assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a protective wrist guard assembly of this invention, indicated generally at 12, is utilized with a snowboard rider 14 mounted on and connected to a snowboard member 16 by snowboard boot members 18 and traversing a snow terrain 20.

The snowboard rider 14 is shown in the act of a falling accident with a right arm member 22 extended outwardly whereupon a forearm section 24 with an interconnected wrist section 26 and a hand section 28 are engageable in a bracing manner against the snow terrain 20.

As the snowboard rider 14 does not utilize ski poles, it is quite common to utilize the wrist and hand sections 26, 28 as a means of bracing oneself during a fall against the snow terrain 20 which frequently results in injury such as bone fractures or breaking of the wrist section 24 of the snowboard rider 14.

The protective wrist guard assembly 12 includes a pair of wrist guard glove assemblies 36, one for each opposite right and left arm member 22 of the snowboard rider 14, as noted in FIG. 1.

Figure 4:
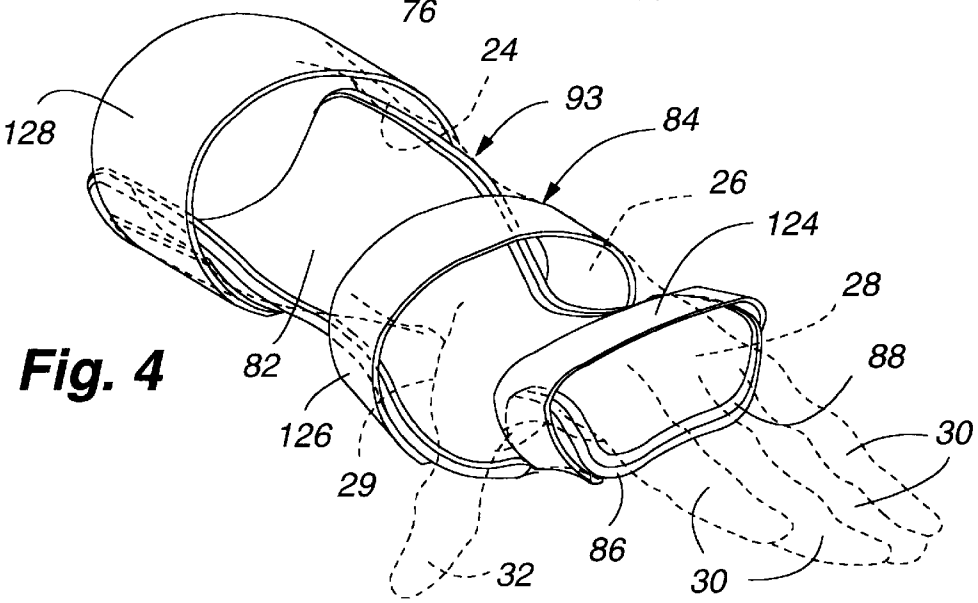
FIG. 4 is a portion of the first embodiment and a perspective view of a second embodiment of the protective wrist guard assembly operable to be strapped on a portion of a person's arm member and inserted within a conventional snowboard or ski cold weather glove assembly.

The hand section 28 of the snowboard rider 14 includes a palm portion 29 having finger portions 30 and thumb portion 32 (FIG. 4).

Each wrist guard glove assembly 36 includes 1) a protective main glove assembly 38; and 2) a wrist support guard assembly 40 mounted within the protective main glove assembly 38.

Figure 3:
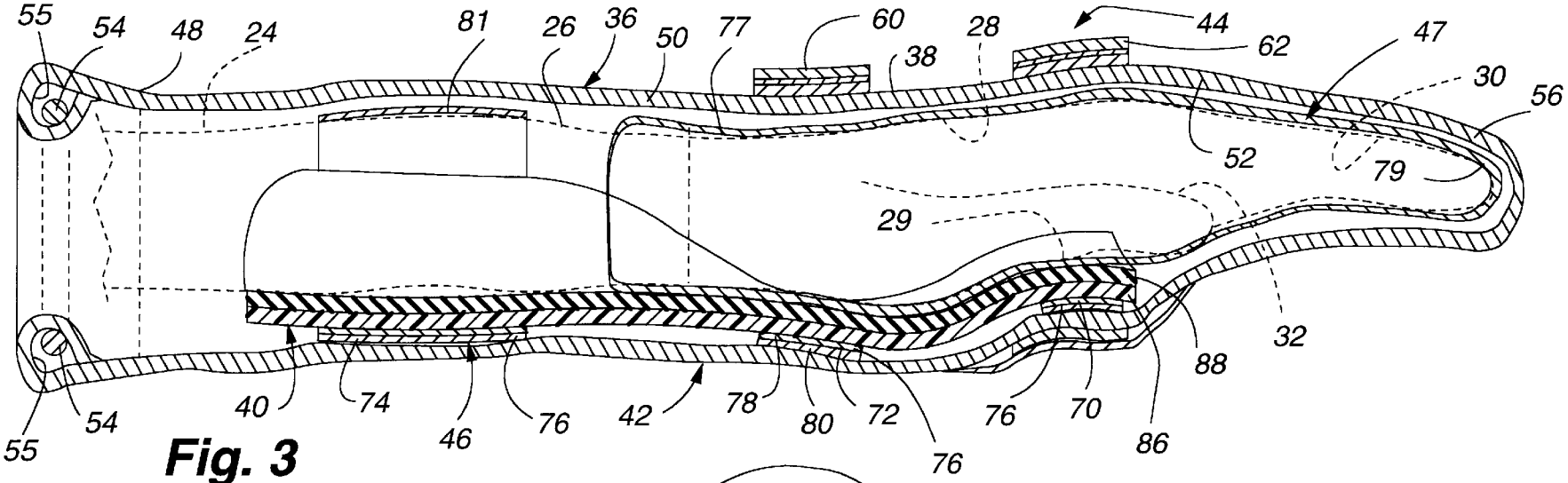
FIG. 3 is an enlarged sectional view taken along line 3—3 in FIG. 2.

As best shown in FIG. 3, the protective main glove assembly 38 includes 1) a main glove body member 42; 2) an exterior anchor assembly 44 connected to the main glove body member 42; 3) an interior insert anchor assembly 46 for securing to the wrist support guard assembly 40; and 4) a glove insert member 47 mounted on a portion of an upper surface of the wrist support guard assembly 40.

The main glove body member 42 includes a forearm cover section 48 integral with a wrist cover section 50 which, in turn, is integral with a hand cover section 52. The forearm cover section 48 is provided with an anchor strap member 54 mounted within a strap support section 55 of loop shape and being operable to selectively enclose and tighten a portion of the forearm cover section 48 about the forearm section 24 of the snowboard rider 14.

Figure 2:
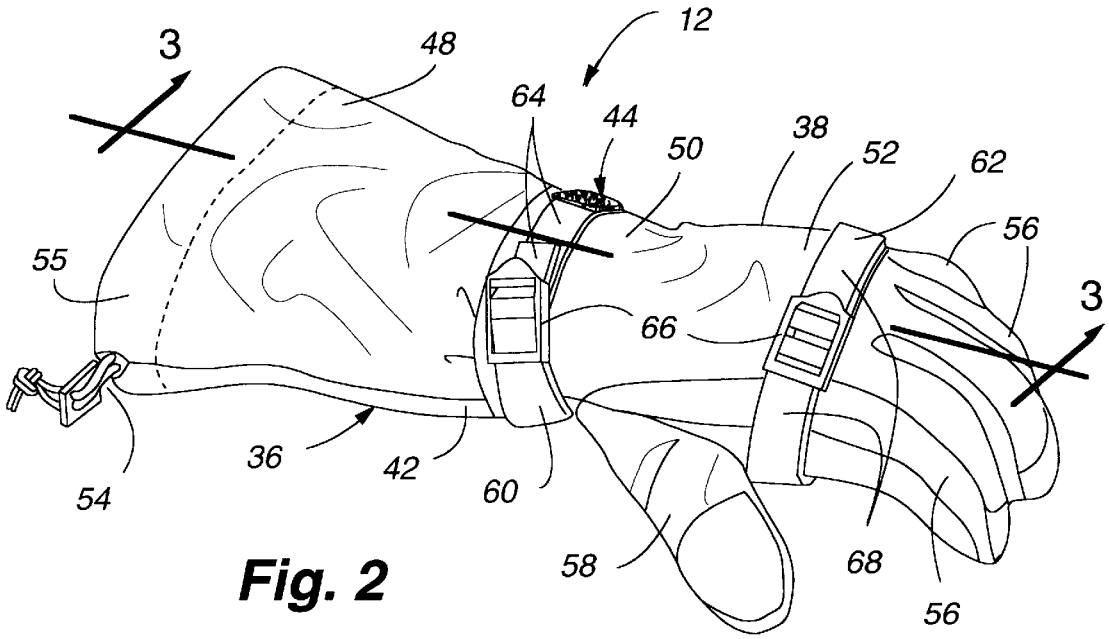
FIG. 2 is a perspective view of one embodiment of the protective wrist guard assembly of this invention.

The hand cover section 52 is provided with individual finger enclosure portions 56 and a thumb enclosure portion 58 as noted in FIG. 2 to receive the respective finger and thumb portions 30, 32 of the hand section 28 of the snowboard rider 14 therein.

The main glove body member 42 resembles a substantially conventional snowboard or ski glove assembly operable to keep the forearm section 24, wrist section 26, and hand section 28 of the snowboard rider 14 in a warm protective condition from extreme cold weather elements.

The exterior anchor assembly 44 is somewhat different from that used on a conventional snowboard or ski glove assembly as serves to grasp, anchor, and enclose the wrist support guard assembly 40 against the respective arm member 22 of the snowboard rider 14 utilizing same.

The exterior anchor assembly 44 includes 1) a wrist anchor member 60; and 2) an upper palmar anchor member 62 as best shown in FIG. 2. The wrist anchor member 60 is provided with a wrist anchor strap 64 having outer ends interconnected as by a conventional anchor buckle member 66. The outer ends are further interconnected by Velcro connectors.

The upper palmar anchor member 62 is provided with a pair of palm anchor straps 68 interconnected by another anchor buckle member 66 and connected to each other by a Velcro connector.

As best shown in FIG. 3, the interior insert anchor assembly 46 includes 1) a palmar anchor member 70; 2) a wrist anchor member 72; and 3) a forearm anchor member 74. The anchor members 70, 72, 74 are substantially identical comprised of Velcro members 76, each having a hook section 78 and a loop section 80 which are interconnected to each other. The Velcro members 76 operate to interconnect an inner surface of the main glove body member 42 with an adjacent abutting portion of the wrist support guard assembly 40.

Further, the forearm anchor member 74 is cooperating with a forearm strap member 81 operable to receive and secure a portion of the forearm section 24 of the snowboard rider 14 against the wrist support guard assembly 40 as shown in FIG. 3.

The glove insert member 47 resembles a conventional glove having a wrist support 77 integral with a palm/finger support 79 and operable to receive the finger and thumb portions 30, 32 of the hand section 28 of the snowboard rider 14 therein as shown in FIG. 3.

The wrist support guard assembly 40 includes a primary support body assembly 82 secured by the interior insert anchor assembly 46 to an interior of the main glove body member 42 (FIG. 3). The primary support body assembly 82 includes an outer support layer member 86 being superimposed on an inner support layer member 88 of identical size, shape, and contour.

The outer support layer member 86 is preferably constructed of a plastic polyethylene material which is rigid in construction, easy to mold, lightweight, and impervious to the absorption of water. The plastic material must be able to sustain extreme variations in temperature from sub zero temperatures to heated room conditions and has excellent impact-absorbing performance.

The inner support layer member 88 is of a cushion type material being preferably of a closed foam rubber material so as to be impervious to the absorption of water but providing a soft cushioning and warming effect to the forearm, wrist, and hand sections 24, 26, 28 of the arm member 22 of the snowboard rider 14 utilizing same.

The superimposed outer and inner support layer members 86, 88 each include a forearm support section 90 integral with an intermediate wrist support section 92 which, in turn, is integral with palm support section 94.

As shown in FIG. 8, the forearm support section 90 includes an arcuate mid portion 96 integral with outer edges being arcuate side wall portions 98. The arcuate mid portion 96 is integral with a tapered connector portion 102 leading to the intermediate wrist support section 92.

As shown in FIG. 7, the intermediate wrist support section 92 includes a palm receiver portion 104 integral with a lateral wrist support portion 106 being of arcuate shape which, in turn, is integral with a thumb wrist support portion 108 of arcuate shape and integral with a hand transition portion 110 leading to the palm support section 94 as best shown in FIG. 7.

As shown in FIG. 10, the palm support section 94 includes an arcuate small finger retainer portion 112 integral with a central palm support portion 114 which, in turn, is integral with a forefinger retainer portion 116.

The overall palm support section 94 is of a generally U-shape but having the central palm support portion 114 being indented and curved to resemble the palm portion 29 of the hand section 28 in a respective arm member 22 of the snowboard rider 14.

The wrist support guard assembly 40 provides support from just below a person's elbow at the forearm section 24 to a distal palmar crease of the palm portion 29 of the hand section 28. This doesn't restrict motion of the finger and thumb portions 30, 32 of the hand section 28 of the snowboard rider 14.

The palm support section 94 inclines upwardly from the wrist support section 92 at a dorsiflexed angle into the functional position of the hand section 28 for comfort. The dorsiflexed angle is preferably between a 20–30 degree angle.

In a second embodiment of the protective wrist guard assembly 12 of this invention as noted in FIGS. 4, 5, 6, and 7 and the sectional views as shown in FIGS. 8, 9, and 10, a basic wrist support guard assembly 93 includes 1) the previously described primary support body assembly 82; and 2) a wrist anchor assembly 84 connected to the primary support body assembly 82. The primary support body assembly 82 includes the inner and outer support layer members 86, 88 as described for the first embodiment.

Figure 5:
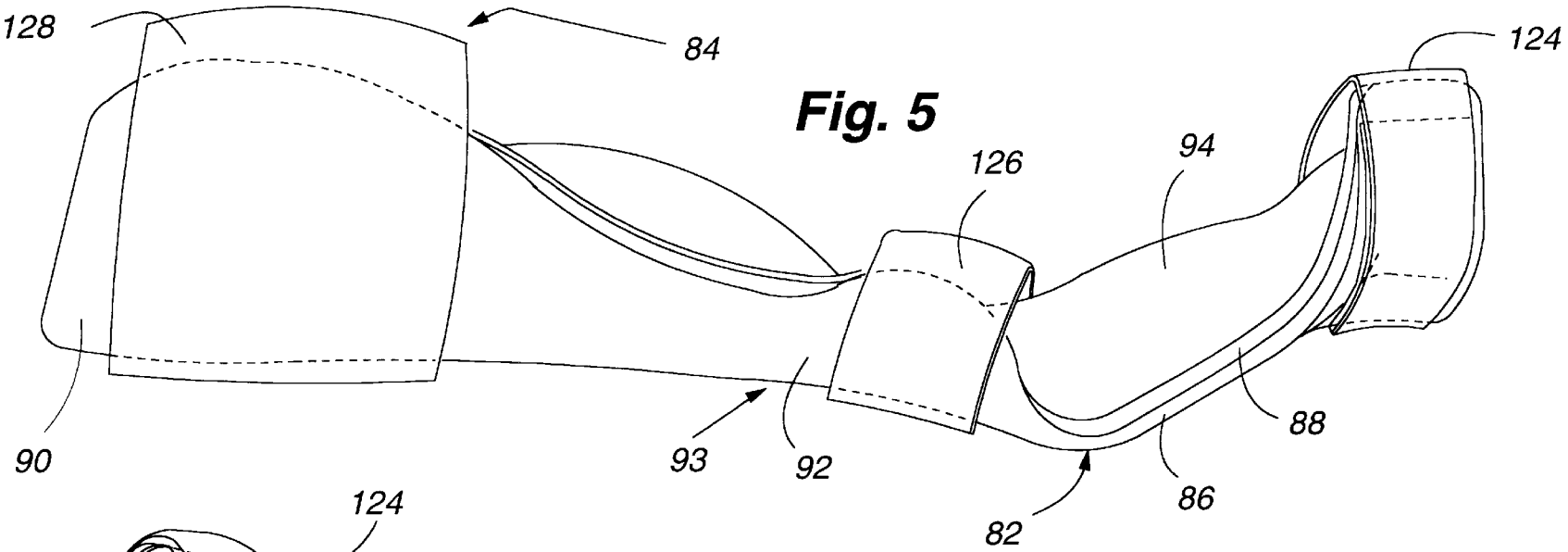
FIG. 5 is an enlarged side elevational view of the embodiment noted in FIG. 4.

As shown in FIG. 5, the wrist anchor assembly 84 includes 1) ah upper palm anchor member 124; 2) a wrist support anchor member 126; and 3) a forearm support anchor member 128. The upper palm anchor member 124 includes a main support strap member 130 having one end section 132 connected to an undersurface of the palm support section 94. Another end section 134 of the main support strap member 130 is releasably secured to the end section 132 by a Velcro member 76.

The end section 132 is secured as by adhesive or other similar means to the undersurface of the palm support section 94.

The end sections 132, 134 are joined together by the Velcro member 76 having a hook section 78 and a loop section 80 similar to the wrist support anchor member 126 and the forearm support anchor member 128.

Figure 6:
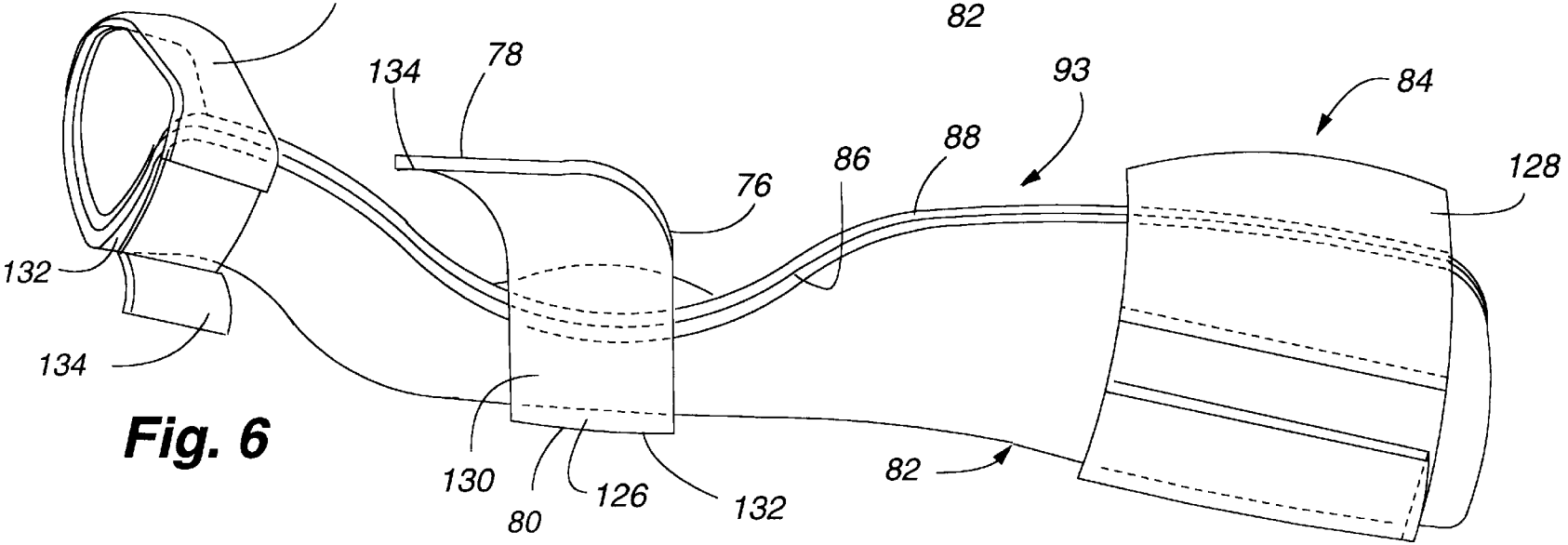
FIG. 6 is a side elevational view opposite that shown in FIG. 5.

The wrist support anchor member 126 and forearm support anchor member 128 are as described for the palm anchor member 124 except that the main support strap member 130 may be of various widths as obvious in FIGS. 5 and 6.

Figure 11:
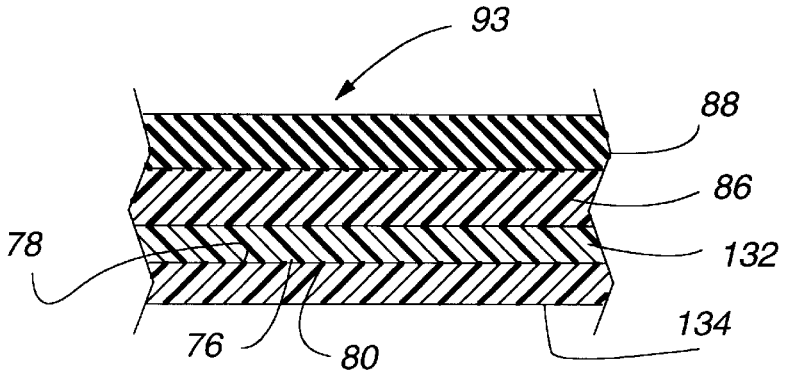
FIG. 11 is an enlarged fragmentary sectional view taken along line 11—11 in FIG. 10.

On referring to FIG. 11, it is noted that the cross sectional view taken along line 11—11 in FIG. 10 shows the composition of the wrist support guard assembly 40 (rubber and plastic) and its interconnection with the Velcro member 76 with the hook section 78 and the loop section 80.

Figure 12:
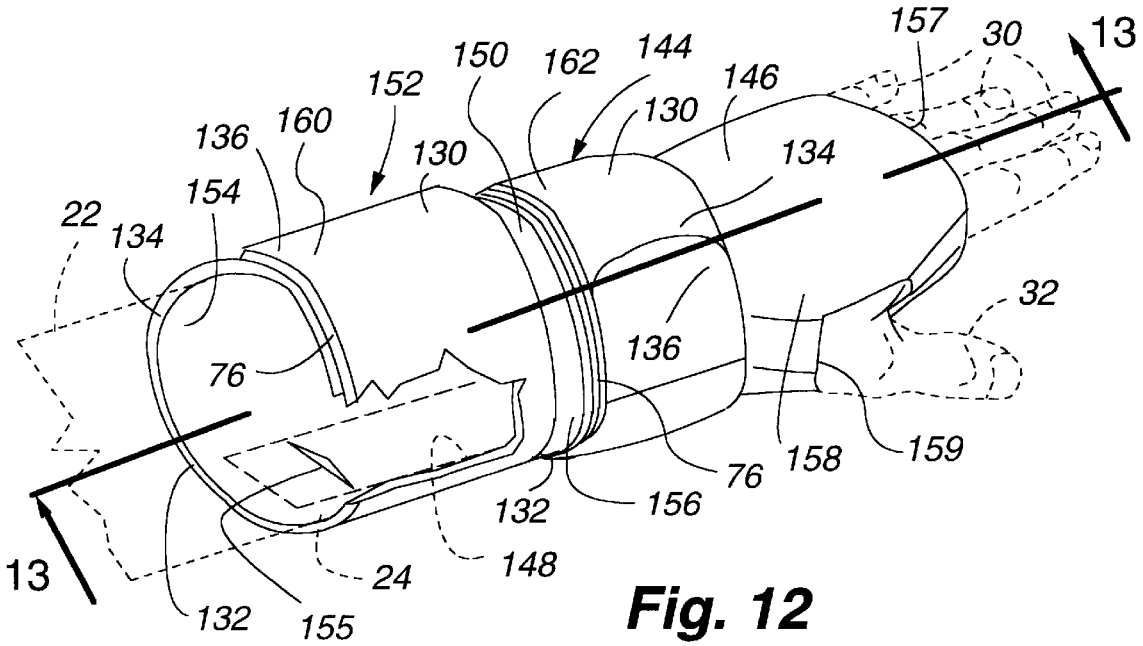
FIG. 12 is a third embodiment being a partial glove wrist guard assembly illustrated as mounted on the forearm, wrist, and hand sections of the snowboard rider illustrated in dotted lines.

A third embodiment of the protective wrist guard assembly 12 of this invention is illustrated in FIGS. 11 and 12 being a partial glove wrist guard assembly 144. The partial glove wrist guard assembly 144 includes 1) a protective partial glove assembly 146; and 2) a wrist support guard member 148.

The protective partial glove assembly 146 includes a partial glove body member 150 having connected thereto a partial glove anchor assembly 152 operable to be secured about the forearm and wrist section 24, 26 of the arm member 22 of the snowboard rider 14 as will be noted.

The partial glove body member 150 includes a forearm support section 154 integral with a wrist support section 156 which, in turn, is integral with a palm support section 158. The forearm support section 154 is provided with a guard receiver slot 155 leading into a support pocket therein to receive the wrist support guard member 148 therein as will be explained.

The palm support section 158 is provided with a finger extension opening 157 and a thumb extension opening 159 allowing the respective finger and thumb portions 30, 32 of the snowboard rider 14 to extend therethrough as shown in dotted lines in FIG. 12. The finger extension opening 157 is provided with finger separation struts for ease of usage.

The partial glove anchor assembly 152 is provided with a forearm support anchor member 160 and a wrist support anchor member 162. The wrist support anchor member 162 includes an outer enclosure strap member 134

The forearm and wrist support anchor members 160, 162 each include a support strap member 130 having an anchor section 132 secured to a portion of the partial glove body member 150. An outer end 136 of the support strap member 130 is releasably connected to respective anchor sections 132 by Velcro members 76 and, more specifically, by the hook sections 78 and the loop sections 80 as previously described.

The enclosure strap member 134 is secured at one end to the wrist support section 156 and operable to be wrapped about the wrist support anchor member 162 and secured to itself by a Velcro member 76. The enclosure strap member 134 provides superior and much needed support to the wrist section 26 of the snowboard rider 14.

Figure 13:
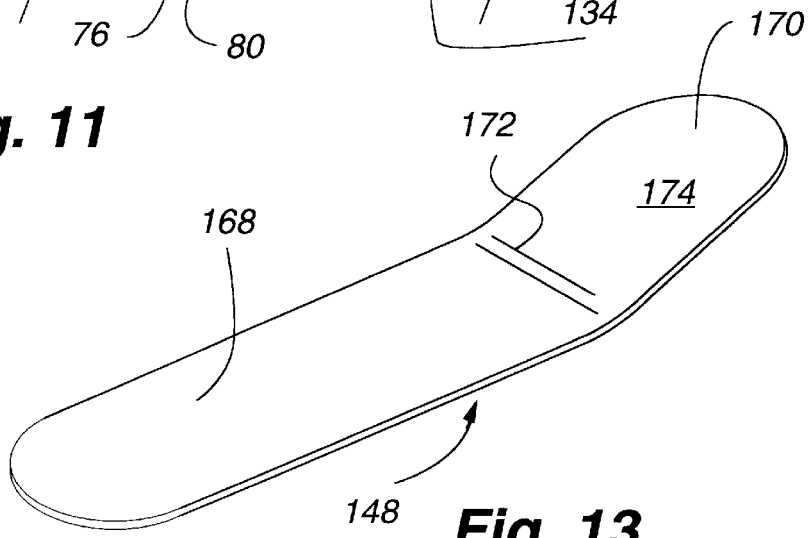
FIG. 13 is a perspective view of a wrist support guard member utilized with the partial glove wrist guard assembly as shown in FIG. 12.

The wrist support guard member 148, as noted in FIG. 13, is preferably constructed of a rigid material such as plastic, aluminum, or stainless steel. The wrist support guard member 148 is provided with a primary support section 168 integral with a palm support section 170. The palm support section 170 is bent at an inclined portion 172 leading to an outer support portion 174.

Relative angles between the primary support section 168 and the support portion 174 can be varied but are preferably between a 20–30 degree angle and, preferably, 25 degrees. This is the angle of dorsiflexion of the wrist section 26 relative to the forearm section 24.

Use and Operation of the Invention

In the use and operation of the protective wrist guard assembly 12 of this invention, we will utilize a pair of the wrist guard glove assemblies 36 being a right and left one to be used on each respective arm members 22 of the snowboard rider 14.

In the first embodiment of FIGS. 2 and 3, it is noted that the snowboard rider 14 would insert its hand section 28 within an outer open end of the forearm cover section 48 of each respective main glove body member 42.

Once the hand section 28 is fully inserted as noted in FIG. 3, it is obvious that the exterior anchor assembly 44 and, more particularly, the left hand section 28, the wrist anchor member 60, and upper palmar anchor member 62 with the anchor straps 64, 68 are drawn inwardly through the respective anchor buckle members 66 to clasp the respective hand section 28 against the primary support body assembly 82 of the wrist support guard assembly 40.

At this time, the snowboard rider 14 would utilize the anchor strap member 54 in the strap support section 55 to enclose and lock same about the forearm section 24 of the snowboard rider 14 to seal same against snow, inclement weather, and the like from reaching the interior of the main glove body member 42.

As noted in FIG. 3, the primary support body assembly 82 and, more particularly, the outer and inner support layer members 86, 88 are to provide substantial shock-absorbing features to the wrist and hand sections 26, 28 of the snowboard rider 14 to provide a shock-absorbing feature when hitting the snow terrain 20 as by a right arm member 22 as noted in FIG. 1.

As noted in FIGS. 7, 8, 9, and 10, the various curved features of the primary support body assembly 82 are important to provide the same curvature and shock-absorbing elements to the forearm, wrist, and hand sections 24, 26, 28 of the snowboard rider 14.

As shown in FIGS. 4, 5, and 6, the second embodiment includes the basic wrist support guard assembly 93 utilizing the identical primary support body assembly 82 as in the first embodiment but using a wrist anchor assembly 84. The wrist anchor assembly 84 is readily anchored to the forearm, wrist, and hand sections 24, 26, 28 of the snowboard rider 14 instead of being anchored to the interior of the main glove body member 42 as shown in FIG. 3.

The second embodiment basic wrist support guard assembly 93 is anchored by the wrist anchor assembly 84 with the main support strap members 130 and the Velcro members 76. This second embodiment provides substantially identical support as to the first embodiment and can be utilized with conventional snowboard and ski glove assemblies by the snowboard rider 14 and would not require purchase of the protective main glove assemblies 38 used in the first embodiment of FIGS. 2 and 3.

As noted in FIGS. 8, 9, and 10, the various curvatures of the forearm, intermediate, and palm support sections 90, 92, 94 are extremely important to provide the necessary support to the arm members 22 of the snowboard rider 14.

A third embodiment, as shown in FIGS. 12, and 13, is an economical structive assembly being the partial glove wrist guard assembly 144 having the protective partial glove assembly 146 with the wrist support guard member 148 inserted through the guard receiver slot 155 and operable to provide support to the forearm, wrist, and hand sections 24, 26, 28 of the snowboard rider 14.

It is obvious that the third embodiment, with the protective partial glove assembly 146 would, in extreme cold weather, be utilized with a snowboard or ski glove assembly provided by the snowboard rider 14 thereof similar to that required with the basic wrist support guard assembly 93 of the second embodiment. This embodiment would be more economical to manufacture due to the configuration of the wrist support guard member 148.

Although there are three embodiments of the protective wrist guard assembly 12 of this invention, all operate in substantially the identical manner on having the wrist support guard assembly 40 or the basic wrist support guard assembly 93 as noted in FIGS. 4, 5, and 6 and, further, utilizing the partial glove wrist guard assembly 144 as shown in FIG. 12 to achieve the same purpose and function of this invention.

The forearm support section 90 of the wrist support guard assembly 40 is operable to hold the radius and ulna bones of the forearm section 24 against twisting movement relative to each other assisted by the forearm support anchor member 128.

Concurrently, the numerous carpal bones in the wrist section 26 are held against rotational movement relative to the radius and ulna bones of the forearm section 24 by the wrist support anchor member 126.

The hand section 28 and, more particularly, the palm portion 29 is held in flexion against the palm support section 94 by the palm anchor member 124.

The third metacarpal bone in the palm portion 29 is held in the dorsiflexed position at an angle of 25+ or −5 degrees relative to the radius and ulna bones in the forearm section 24.

The palm anchor member 124 engages the bones adjacent and inwardly of knuckles on the finger portions 30 and doesn't hinder flexible movement of the thumb portion 32. The finger portions 30 and the thumb portion 32 of the hand section 28 remain free and flexible from the wrist support guard assembly 40, the basic wrist support guard assembly 93, and the wrist support guard member 148

The protective wrist guard assembly is easy to use, providing protection to the right and left hand sections of the snowboard rider thereof; easy to assemble and disassemble; providing an enclosure to the hand section of the snowboard rider thereof; providing an inexpensive wrist support guard assembly attached to the forearm, wrist, and hand sections of the snowboard rider as by strap members to be securely anchored thereto; providing an inexpensive model to be placed about the forearm, wrist, and hand sections of the snowboard rider thereof and secured thereto as by anchor strap members; economical to manufacture; and substantially maintenance free.

While the invention has been described in conjunction with preferred specific embodiments thereof, it will be understood that this description is intended to illustrate and not to limit the scope of the invention, which is defined by the following claims:

I claim:

1. A protective wrist guard assembly including a wrist guard glove assembly to be worn about forearm, wrist, and hand sections of a person to prevent injury thereto, comprising:

a) a protective main glove assembly includes a main glove body member operable to receive a forearm, wrist, and hand section of an individual therein;

b) a wrist support guard assembly mounted within said main glove body member operable to receive and support a portion the forearm section, the wrist section, and a portion of the hand section of the individual thereon;

c) said wrist support guard assembly includes a support layer member having a forearm support section integral with a wrist support section which, in turn, is integral with a palm support section; and d) said protective main glove assembly includes an exterior anchor assembly, including a pair of spaced exterior anchor members, operable to selectively, adjustably, and releasably secure said main glove body member and said support layer member against the forearm, wrist, and hand sections of the individual to restrict flexing movement between the wrist section and the hand section of the individual to prevent injury thereto when striking an object.

2. A protective wrist guard assembly as described in claim 1, wherein:

a) said protective main glove anchor assembly having interior wrist guard anchor assembly having interior anchor members operable to secure said support layer member by respective spaced ones of a palm anchor member, a wrist anchor member, and a forearm anchor member internally of said main glove body member to anchor therein.

3. A protective wrist guard assembly as described in claim 1, wherein:

a) said protective main glove assembly includes a glove insert member to be placed within said main glove body member and operable to receive the forearm, wrist, and hand section of the individual therein.

4. A protective wrist guard assembly as described in claim 1, wherein:

a) said palm support section extended laterally and upwardly from said wrist support section operable to support a palm portion of the hand section of the individual at an inclined and substantially non-moving dorsiflexed position to prevent injury to the wrist section when striking the object.

5. A protective wrist guard assembly as described in claim 1, wherein:

a) said protective main glove assembly includes said exterior anchor assembly having one of said exterior anchor members being a wrist anchor member and another one of said exterior anchor members is an upper palmar anchor member adjustably clamped about said main glove body member to secure the wrist section and the portion of the hand section of the individual against said support layer member to prevent movement thereof.

6. A protective wrist guard assembly as described in claim 1, wherein:

a) said forearm support section, said wrist support section, and said palm support section shaped to conform to an actual contour and shape of the like forearm, wrist, and hand sections of the individual using same; and b) said forearm support section of an arcuate shape in transverse cross section to provide lateral support to a large portion of the individual's forearm section mounted therein.

7. A protective wrist guard assembly as described in claim 1, wherein:

a) said wrist support guard assembly includes an inner support layer member superimposed and anchored to said support layer member;

b) said support layer member constructed of a rigid, water impervious material; and c) said inner support layer member constructed of a water impervious material cushion material.

8. A protective wrist guard assembly as described in claim 1, wherein:

a) said palm support section at a 20–30 degree angle relative to said wrist support section operable to hold the individual's wrist section in a dorsiflexed position being slightly flexed into the functional position of the individual's hand section.

9. A wrist support guard assembly to be mounted about forearm, wrist, and hand sections of an individual to prevent comprise thereto, comprising:

a) a basic wrist support guard assembly includes a primary support body assembly having a support layer member;

b) said support layer member having a forearm support section integral with an intermediate wrist support section which, in turn, is integral with a palm support section;

c) said forearm support section of a semi-circular shape in transverse cross section operable to receive and support a lower portion of a similarly shaped forearm section of an individual;

d) said wrist support section of a smaller arcuate shape in transverse cross section than an arcuate section of the forearm support section and operable to receive and support a similarly shaped wrist section of an individual; and e) said palm support section having a palm portion of trough shape and arcuate shape in transverse cross section which is smaller than said arcuate shape of the forearm support section and larger than said arcuate shape of the wrist support and palm, and palm section operable to receive and support a similarly shaped palm section of an individual in an inclined and substantially non-moving dorsiflexed position to prevent injury to the wrist section;

whereby said support layer member is operable to receive and support the forearm, wrist, and palm sections of an individual to minimize injury thereto when forced against a firm surface when falling thereagainst.

10. A wrist support guard assembly as described in claim 9, wherein:

a) said basic wrist support guard assembly includes an arm anchor assembly having a plurality of spaced anchor members operable to secure said primary support body assembly against respective ones of the forearm, wrist, and hand sections of the individual utilizing same to hold immobile the wrist section in the inclined dorsiflexed position to prevent injury thereto when striking an object.

11. A wrist support guard assembly as described in claim 9, wherein:

a) said palm support section extended at an angle of 25+ or −5 degrees relative to said wrist support section to hold the wrist section of the individual at a dorsiflexed angular position which is the function position of the hand for comfort.

12. A glove wrist guard assembly adapted to be mounted about a forearm, wrist, and hand sections of an individual to prevent injury thereto, comprising:

a) a protective glove assembly operable to receive and enclose a portion of a forearm, a wrist, and a portion of a hand of an individual therein;

b) a wrist support guard member constructed of a semi-rigid and slightly flexible material and mounted within said protective glove assembly; and c) said wrist support guard member includes a first section of a semi-circular shape in transverse cross section to receive and support the individual's forearm and hold against lateral movement; a second section of arcuate shape in transverse cross section of a smaller arcuate shape than the said first section and configure to receive and support the individual's wrist; and a third section of trough shape in transverse cross section of a smaller arcuate shape than the said first section, but of a larger arcuate shape than the said second section and configured to receive and support an individual's palm thereagainst;

whereas said wrist support guard member holds the individual's palm immobile at an angle relative to the individual's wrist to prevent further pivotal movement thereof and limit injury to the wrist on striking an object with one's hand.

13. A glove wrist guard assembly as described in claim 12, wherein:

a) said wrist support guard member having said third section extended laterally and upwardly at a 25+ or −5 degree angle from said first section to hold the individual's palm at a dorsiflexed position relative to the individual's wrist.

14. A wrist support guard assembly to be mounted about forearm, wrist, and hand sections of an individual to prevent injury thereto, comprising:

a) a basic wrist support guard assembly includes a primary support body assembly having a support layer member of an irregular shape conforming to the forearm, the wrist, and a dorsiflexed position of the hand section of the individual having said wrist support guard assembly mounted thereon;

b) said support layer member having a forearm support section integral with an intermediate wrist support section which, in turn, is integral with a palm support section;

c) said forearm support section operable to receive and support a substantial portion of a forearm section of an individual and restrict lateral movement thereof the said forearm support section is of an arcuate shape in transverse cross section;

d) said wrist support section of an arcuate shape in transverse cross section operable to receive and support a similarly shaped wrist section of an individual and the wrist support section of a smaller arcuate shape in transverse cross section than said arcuate shape of the forearm support section; and e) said palm support section having a palm portion of trough shape in transverse cross section operable to receive, support, and restrict lateral movement of a similarly shaped palm section of an individual while allowing normal functions of the individual's thumb and finger members and the palm support section of a smaller arcuate shape in transverse cross section than said arcuate shape of the forearm support section but of a larger arcuate shape than said arcuate shape of the wrist support section;

whereby said support layer member is operable to receive and support the forearm, wrist, and palm sections of an individual to minimize injury thereto when forced against a firm surface when falling thereagainst.

15. A wrist support guard assembly as described in Claim 14, wherein:

a) said forearm support section is of a length equal to approximately one-half of a length of the individual's forearm section operable to receive, transfer, and dissipate shock forces against the individual's wrist section encountered on striking an object to prevent injury thereto.

16. A wrist support guard assembly as described in claim 14, including:

a) said support layer member constructed of a semi-rigid and slightly flexible material;

b) a cushioning support layer is secured to said support layer member to provide a comfortable and shock-absorbing feature to the forearm, wrist, and hand sections of the individual wearing said wrist support guard assembly; and said palm support section to hold the palm section of the individual in an angular dorsiflexed position to prevent injury thereto.

* * * * *